US008172778B2

(12) United States Patent
Sim et al.

(10) Patent No.: US 8,172,778 B2
(45) Date of Patent: May 8, 2012

(54) PNEUMATIC MASSAGING DEVICE

(75) Inventors: Chye Hock Ron Sim, Singapore (SG); Sain Keat Ken Chuang, Singapore (SG); Kia Tong Tan, Singapore (SG)

(73) Assignee: OSIM International, Ltd., Singapore (SG)

( * ) Notice: Subject to any disclaimer, the term of this patent is extended or adjusted under 35 U.S.C. 154(b) by 1018 days.

(21) Appl. No.: 11/793,903

(22) PCT Filed: Dec. 17, 2004

(86) PCT No.: PCT/SG2004/000420

§ 371 (c)(1),
(2), (4) Date: Apr. 7, 2008

(87) PCT Pub. No.: WO2006/065225

PCT Pub. Date: Jun. 22, 2006

(65) Prior Publication Data

US 2009/0076424 A1 Mar. 19, 2009

(51) Int. Cl.
*A61H 7/00* (2006.01)

(52) U.S. Cl. ..... 601/148; 601/151

(58) Field of Classification Search ..... 602/13, 602/23, 27; 601/18, 22, 148–152
See application file for complete search history.

(56) References Cited

U.S. PATENT DOCUMENTS

| | | | | |
|---|---|---|---|---|
| 1,976,656 | A | 10/1934 | Clark | |
| 4,722,332 | A * | 2/1988 | Saggers | 602/62 |
| 5,435,009 | A * | 7/1995 | Schild et al. | 2/22 |
| 5,551,173 | A | 9/1996 | Chambers | |
| 5,813,142 | A | 9/1998 | Demon | |
| 5,894,687 | A | 4/1999 | Lin et al. | |
| 6,001,119 | A * | 12/1999 | Hampson et al. | 606/202 |
| 6,014,823 | A | 1/2000 | Lakic | |
| 6,632,188 | B2 | 10/2003 | Thomas et al. | |
| 7,282,038 | B2 * | 10/2007 | Gillis et al. | 601/151 |
| 2001/0042321 | A1 | 11/2001 | Tawney et al. | |
| 2002/0133106 | A1 | 9/2002 | Peled | |

* cited by examiner

*Primary Examiner* — Michael A. Brown
(74) *Attorney, Agent, or Firm* — Stout, Uxa, Buyan & Mullins; Carlos A. Fisher

(57) ABSTRACT

A pneumatic massaging device comprising a first inflatable part (15) to be in contact with a foot of a user, wherein said first inflatable part comprises at least two inflatable chambers (21, 26). The first of said at least two inflatable chambers is designed such that it is in contact with the plantar arch (8) and sole regions of the foot and the second of said at least two inflatable chambers is designed such that it is in contact with the sole region (5), lateral region (4) or vamp region (3) of the foot. The pneumatic massaging device is designed such that the first inflatable part (15) may further comprise a third inflatable (26) chamber. This third chamber is designed such that it is in contact with the sole of the foot. Furthermore, the first inflatable part (15) may also comprise a plurality of inflatable chambers wherein said plurality of inflatable chambers is designed such that it is in contact with or adjacent to the sole of the foot.

29 Claims, 14 Drawing Sheets

PNEUMATIC MASSAGING DEVICE

The present invention relates to a pneumatically actuated massaging device, in particular to a foot or body massaging device that aims to provide a stimulating and stress relieving massage to the foot, calf or body of a user in order to ease tension and improve blood circulation and may employ, if necessary, the principles of reflexology in order to achieve the desired effect.

Reflexology is a technique that involves the massaging of particular regions of the soles of feet. The basic principle behind it stems from the belief that all the organs and muscles of the body are connected via our nervous system to the said particular regions on the soles of our feet. Thus, a massage applied to those regions of the sole is believed to have the effect of promoting blood circulation to the target organ or muscle. Regardless of the authenticity of this belief, it is medically accepted that a stimulating massage to the feet does yield substantial benefits such as, for example, relaxation, stress and pain relief.

U.S. Pat. Nos. 5,551,173, 5,894,687 and 6,632,188 disclose devices that provide therapeutic massages to the feet whilst in the form of what is essentially, a shoe. U.S. Pat. No. 5,551,173 describes an insole for a shoe. The insole has nodes protruding out of one surface. The user exerts his weight upon the insole and correspondingly, the nodes exert a reaction force upon the soles of the feet of the user. The reaction force generated is, to a large degree, dependent upon the weight of the user meaning that the user has little or no direct control over the massage forces that he experiences. Furthermore, if a user sits down, the massaging effect would be negligible, as the bulk of the weight of a user would then be borne by the supporting structure upon which the user was resting.

U.S. Pat. No. 5,894,687 discloses a shoe sole that comprises a plurality of bulbs that are evenly distributed over the sole's surface. Also on the sole are two larger bulbs that are connected by a passage and contain a fluid. The purpose of the fluid-filled bulbs is to create a pressure-transferring device. As a user undergoes bipedal locomotion, the reactive forces applied to the sole of a user vary due to the presence of the fluid-filled bulbs. When the pressure-transferring device is coupled with a plurality of bulbs on the insole, the resulting shoe pad produces a massaging effect. Again, as previously mentioned, the reaction force generated is entirely dependent upon the weight of the user meaning that, yet again, the user has little or no direct control over the massage forces that he experiences. Furthermore, as mentioned above, if a user sits down, the massaging effect would be negligible.

U.S. Pat. No. 6,632,188 discloses an air foot massaging apparatus comprising a pair of boot-shaped structures. Each boot-shaped structure includes a plurality of compressible and expandable air nodes that engage the foot of a user. In addition to this, the massaging device further includes a vibration motor to provide for added stimulation. According to this U.S. patent, the boots are attached together and are bulky and lacking in mobility due to the massaging apparatus requiring a connection to a power socket via a power cord. In addition, the massaging apparatus as such is disclosed as being an insert for a pair of boots, the said massaging apparatus appears incapable of functioning when separated from the boot structure.

Foot-massaging devices that are presently known lack the required aspects of being both easy and cost effective to fabricate. Accordingly, there is a need for a foot-massaging device that is portable, easy to fabricate by existing means and yet, cost-effective.

It is therefore an objective of the present invention to provide such a massaging device as defined by the independent claim. Although the following description may relate to a pneumatic foot-massaging device with respect to just one foot, it is to be understood that all that is described relates to the corresponding foot as well.

The pneumatic massaging device of the invention comprises at least one inflatable part that exerts a sensible massaging force on the foot of a user. This may be achieved by direct contact (with the skin) of the foot of a user or indirectly, for example, through an intermediate layer arranged between the massaging device and the foot of a user. In the exemplary embodiment of the massaging device incorporated into a shoe, the contact with a foot of a user may occur through said intermediate material within the shoe. The intermediate layer may for example also be a sock a user is wearing during the massage. The said inflatable part comprises at least two inflatable chambers. These two inflatable chambers are designed such that the first of the two inflatable chambers may be able to conform to the sole of a foot while the second inflatable chamber may conform to the plantar arch, lateral and vamp regions of a foot.

In another embodiment, it is also possible for the at least one inflatable part to comprise additional inflatable chambers, such as three inflatable chambers, for example. In such an embodiment, the third inflatable chamber may be situated such that it contacts the sole of a foot. The third inflatable chamber itself may comprise at least two sub-chambers. The two sub-chambers of the third inflatable chamber may be in fluid communication with the third inflatable chamber such that any fluid entering the third inflatable chamber flows into its corresponding sub-chambers as well.

In embodiments wherein the at least one inflatable chamber comprises of a plurality of inflatable chambers, each inflatable chamber may also comprise at least two inflatable sub-chambers. The purpose of having said plurality of inflatable chambers and sub-chambers goes to providing additional support and massaging stimuli to the foot of a user.

According to the above-mentioned embodiment wherein the inflatable part comprises of three inflatable chambers, the inflatable part may be fabricated as a single entity such that said single entity, being a sheet, may comprise all three or more chambers with the third chamber being located in-between the first and second chamber. The three chambers may be situated adjacent to each other but are separated by a partition element. Similarly, the sub-chambers of the third inflatable chamber may also be separated by said partition elements. The same may apply to the aforesaid embodiment wherein at least one inflatable part comprises a plurality of inflatable chambers and sub-chambers. Heat-sealing, ultrasonic sealing, dielectric sealing, adhesion bonding and solvent bonding may be used to fabricate the said partition elements. By leaving an unsealed gap in the partition element along the shared partition element between the third inflatable chamber and sub-chamber, a fluid flow corridor may be formed. The breadth of the fluid flow corridor may vary in length and is dependent on the dimensions of the foot-massaging device. For example, in one exemplary embodiment the size of the unsealed gap may vary between 5 mm-15 mm according to the design requirements. However, the unsealed gap size is not fixed and varies according to the size of the inflatable part and the number of chambers or sub-chambers contained therein.

In another embodiment, the massaging device may incorporate an additional inflatable part that comprises at least two inflatable chambers. The purpose of incorporating any subsequent inflatable part would be to ensure that the specific regions such as the metatarsal, plantar and heel regions, amongst others, receive additional massage forces that may be applied as necessary. In this respect, where applicable, the massaging device may comprise a plurality of additional inflatable parts. The inflatable chambers may also be separated from each other via said partition elements. The second inflatable part may be attached to the third inflatable chamber of the first inflatable part (according to the embodiment where the first inflatable part comprises three inflatable chambers) such that the second inflatable part will be in contact with the plantar arch, lateral, and sole regions of a foot. The second inflatable part may be attached to the third inflatable chamber by snap fitting, glue bonding, tight fitting, locking mechanisms and heat bonding.

In the embodiment where the first inflatable part comprises a plurality of inflatable chambers, the plurality of additional inflatable parts may be attached, where suitable, to any of the said plurality of inflatable chambers of the first inflatable part.

Both the first and second inflatable parts may be fabricated using any such suitable material as is found in the group of polymer-based materials. Possible materials may include, but are not limited to, polyethylene, polypropylene or polyvinyl chloride, for example. Additionally, the materials used may also be derived from the elastomers group consisting of fluorosilicone rubber, ethylene propylene diene monomer or polytetrafluoroethylene.

The massaging device may also include a fluid port, which may be present in one inflatable chamber, in a plurality of inflatable chambers or in every single inflatable chamber. The fluid ports may be fabricated in a manner such that they assist in the attachment of the second inflatable part to the first. Or in another embodiment, the fluid port may be less conspicuously located along the peripheral edge of the selected chambers. The said fluid port may be fabricated from, but is not limited to, polymer-based materials or thermoplastics such as Polyvinyl Chloride (PVC), Polypropylene and if possible, from elastomers as well. The advantages of using thermoplastics or polymer-based materials are that they are lightweight, durable and provide an easy but yet cost-effective means of fabricating the said fluid port.

In another embodiment where all the inflatable chambers comprise fluid ports, the fluid ports present on the second inflatable part may be fabricated to be dimensionally longer than those present on the first inflatable part. By providing for cutouts of a particular dimension within the third chamber of the first inflatable part, the dimensionally longer fluid ports of the second inflatable part may be threaded through the cutouts so as to achieve a tight fit attachment of the two inflatable parts. It is preferred that the diameter of the cutout on the first inflatable part be such that it ensures a tight fit around the fluid port of the second inflatable part or allow for a snap fit where possible thereby eliminating the need for additional fastening devices. In addition, the mentioned attaching mechanism renders the second inflatable part detachable, as is the first.

In another preferred embodiment, the fluid port may allow for unidirectional and bidirectional fluid flows. This would provide for the inflow and outflow of the fluid from the inflatable chambers. In the case where the port allows for only unidirectional flow, the fluid port only allows for the inflow of a fluid, the inflatable chambers and sub-chambers may be vented provided the first and second inflatable parts comprises a semi permeable membrane or from specific vents mounted to facilitate the venting of a fluid. The working fluid may then be vented to the surroundings and as such, in the embodiment where the massaging device is incorporated in a shoe, an added advantage of this would be the establishment of a cooling or heating cycle within the shoe. This may aid in the evaporation of sweat thereby keeping the foot of a user cool and dry. A further advantage may be the inclusion of an antibacterial or odor-removing agent using the gas to act as a carrier. The gas would carry and deposit the said agents onto a foot thereby not only providing a massage but also aid in improving the general hygiene of a foot.

The above-mentioned massaging device may be incorporated into a shoe, glove, and sock or into attire that already exists for general areas of the body. However for particular body members, such as the forearm, knee and neck, where regular attire does not exist, the massaging device may be in the form of a wrap-around jacket brace. In order to facilitate the incorporation of the device into other possible embodiments, for example a shoe, the first inflatable part may be fabricated as separate pieces wherein each inflatable chamber (be it two or more inflatable chambers) is fabricated separately as individual components from the other but nonetheless, assembled within a shoe to provide the above-mentioned form and function of a pneumatic foot massaging device. This may offer the added advantage of allowing each individual component to better conform to the contours that make up the various regions of a human foot as the shape that a chamber may take, when in use, is not constrained by any shape adopted by their related components.

A preferred working fluid in the preferred embodiment of the foot-massaging device should be gaseous. Examples of such gases that may be used are derived from a group comprising of air, nitrogen ($N_2$), any noble gas or any other non-toxic gas that is convenient and cost-effective to incorporate into the device. A liquid, such as water or any other non-toxic liquid may also be used either entirely or in conjunction with a gas. In a further embodiment, the gas may be pumped through liquid filled chambers that are already subjected to the massaging mechanical forces thereby possibly causing rippling effects that may simulate a vibrating effect to the foot of a user.

Each of the above-mentioned fluid ports may be connected to a pump via at least one fluid flow tube. The said pump, in a particular embodiment, may be located in the insole of the shoe and may comprise a fluid pressure sensor that would monitor the fluid pressure within the main and sub-chambers. Accordingly, the fluid pressure sensor may be able to adjust the pressure within the said chambers and thereby increase or decrease the pressure exerted upon the foot of a user, giving rise to varying massage intensities.

In another embodiment of the invention, the massaging device may further comprise a controller that is able to control the inflation and deflation of the various above-mentioned chambers sequentially or in parallel in a fixed or programmable pattern. The pressure regulating sensor, functioning in conjunction with a controller, may be able to vary the pressure within each said chamber as well as the duration of each massage cycle thereby better customizing the intensity and duration of the massage forces exerted upon users.

A further advantage of incorporating a controller with a fixed or programmable pattern into the present invention is that with the presence of the second inflatable part, even more specific points of the foot may be targeted for massage especially since if the second inflatable part may comprise smaller modules that may be actuated by the pneumatic system to press into the foot of a user. By accurately applying pressure at designated points, the foot-massaging device may incorporate elements of reflexology into the designated massage cycle.

The massaging stimuli produced by the massaging device depend upon the inflation sequence programmed in the controller. Accordingly, the controller will inflate and deflate the necessary chambers and parts in accordance with the said pre-programmed massage patterns. Portions of the foot are compressed in a cyclic fashion. In one embodiment wherein the massaging device comprises of a first (further comprising of three sub-chambers) and second part (further comprising of 2 sub-chambers), the inflation sequence is as follows:

1. The inflation of the three sub-chambers of the first part occurs sequentially, concurrently or partially concurrent to each other.
2. During or after the inflation of the first part, the first and second sub-chambers of the second part are inflated either sequentially, concurrently or partially concurrent to each other.
3. The fluid contained in the all the sub-chambers of the first and second inflated parts are vented either sequentially, concurrently or partially concurrent to each other.

The above-mentioned embodiment wherein the massaging device comprises of two inflatable parts is an exemplary embodiment for the sequence of inflating said massaging device. The above sequence is not limited to the said embodiment and is applicable to the all other mentioned embodiments as well.

The accompanying drawings will serve to further illustrate the embodiments as mentioned in the description. They will also serve as an illustration to the possible form and shape of the present invention and the detailed explanation that follows will aid in the understanding of the present invention.

In this respect, it is noted that the shape of the first and subsequent inflatable parts is by no means limited to that as illustrated in the drawings. Instead, the design and shape of any of the aforesaid inflatable parts, chambers and sub-chambers are such that they may conform and adhere adequately to the general contours of the various mentioned regions of the foot.

In this regard, the first inflatable part may, for example, resemble a quadrilateral that, when incorporated into a shoe, contacts the foot of a user sufficiently to provide a stimulating massage. Similarly, any other designated shape that achieves the above-mentioned purpose of providing adequate sensible contact to the foot of a user may be utilized in the fabrication of the said inflatable parts of the massaging device.

As for the second and subsequent additional inflatable parts, they may be shaped to provide additional support and stimulation to the foot of a user by also being shaped to conform adequately to the contours of the foot. The second inflatable part, for example, may be considered to be rectangular in shape, or more generally, to resemble a quadrilateral that includes specific partitions and shaped boundaries to provide the above-mentioned additional support to the sole, plantar arch, metatarsal or lateral regions of the foot.

It should also be noted that although not all tubes and connections are illustrated, a person skilled in the art knows that such additional connectors are necessary.

With reference to the figures, exemplary embodiments of the invention are also shown.

Figure 1:
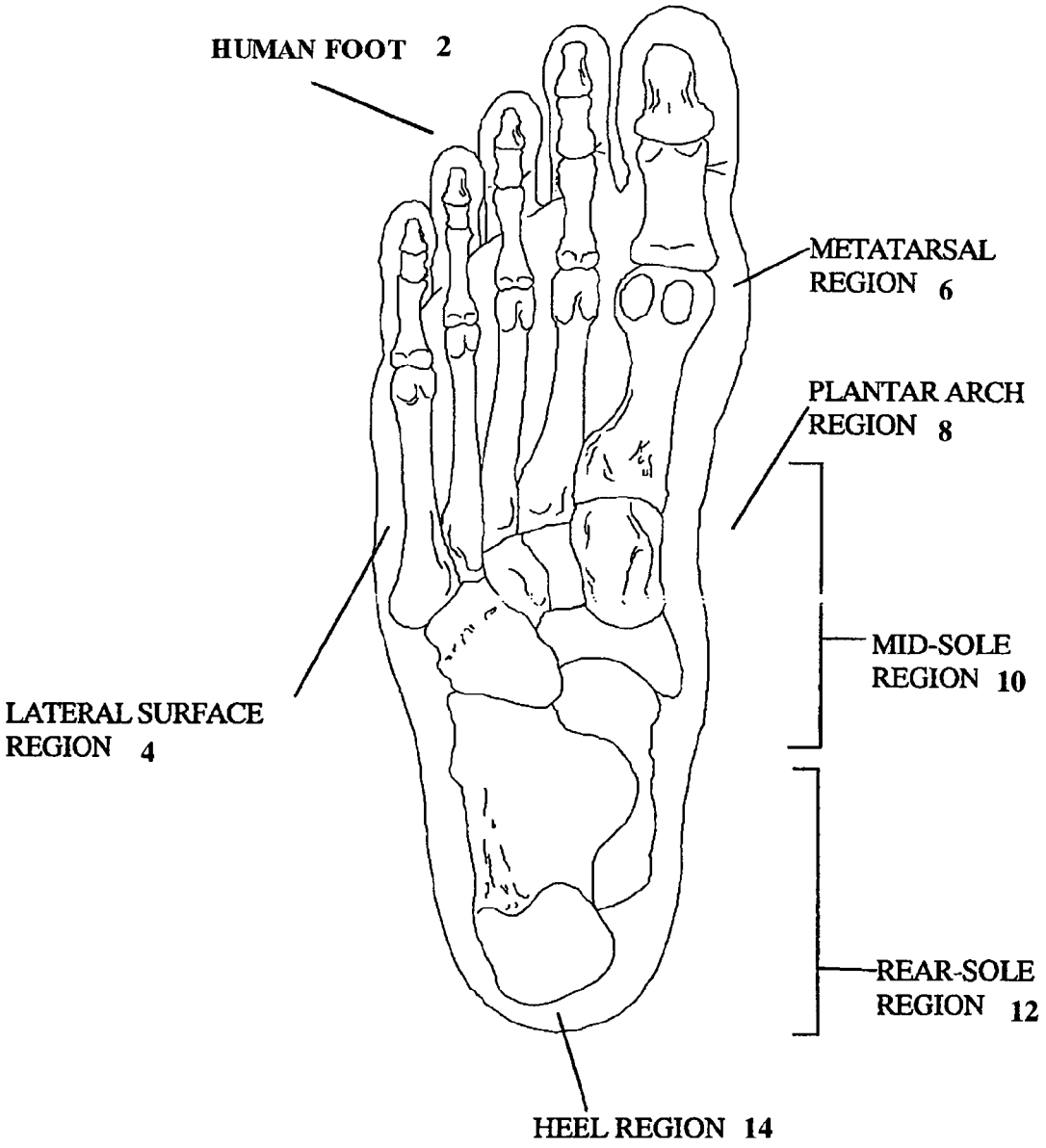
FIG. 1 is an illustration of the human foot from the top sagittal view.

FIG. 1 is a sagittal view of the human foot 2. The lateral surface region 4, metatarsal region 6, plantar region 8, midsole region 10 and rear sole region 12 are shown. These regions are the areas upon which the present invention will typically, but not limited to, exert a massaging force in order to provide muscular stimulation to the foot 2 of a user.

Figure 2:
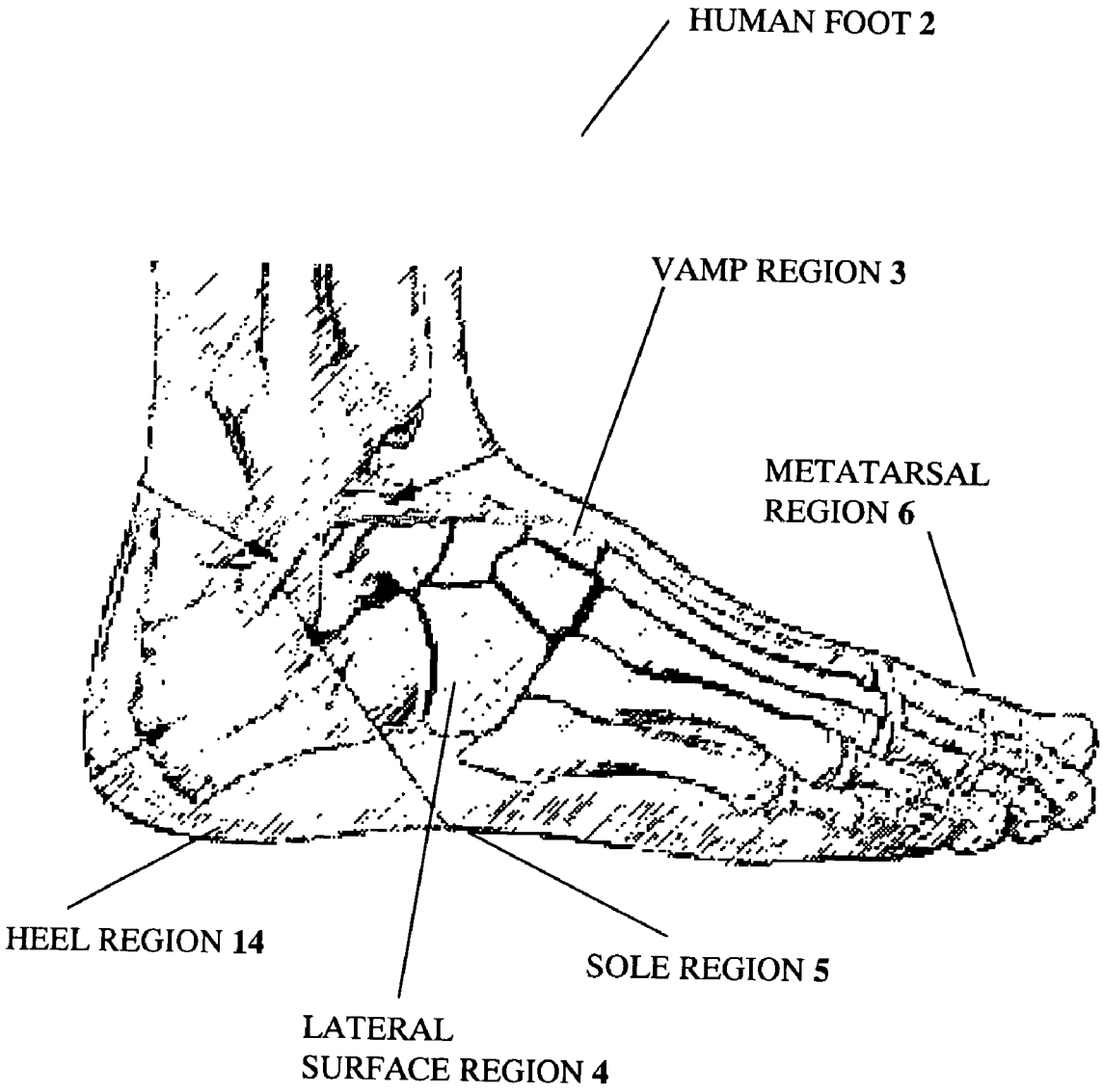
FIG. 2 is an illustration of the human foot from the lateral (inside) view.

FIG. 2 is a lateral (inside) view of the human foot 2. The lateral region 4, metatarsal region 6, vamp region 3, sole region 5 and heel region 14 are shown. These regions, with the exception of heel region 14, are the areas upon which the present invention will exert a massaging force via the various inflatable chambers in order to provide muscular stimulation to the foot 2 of a user.

Figure 3:
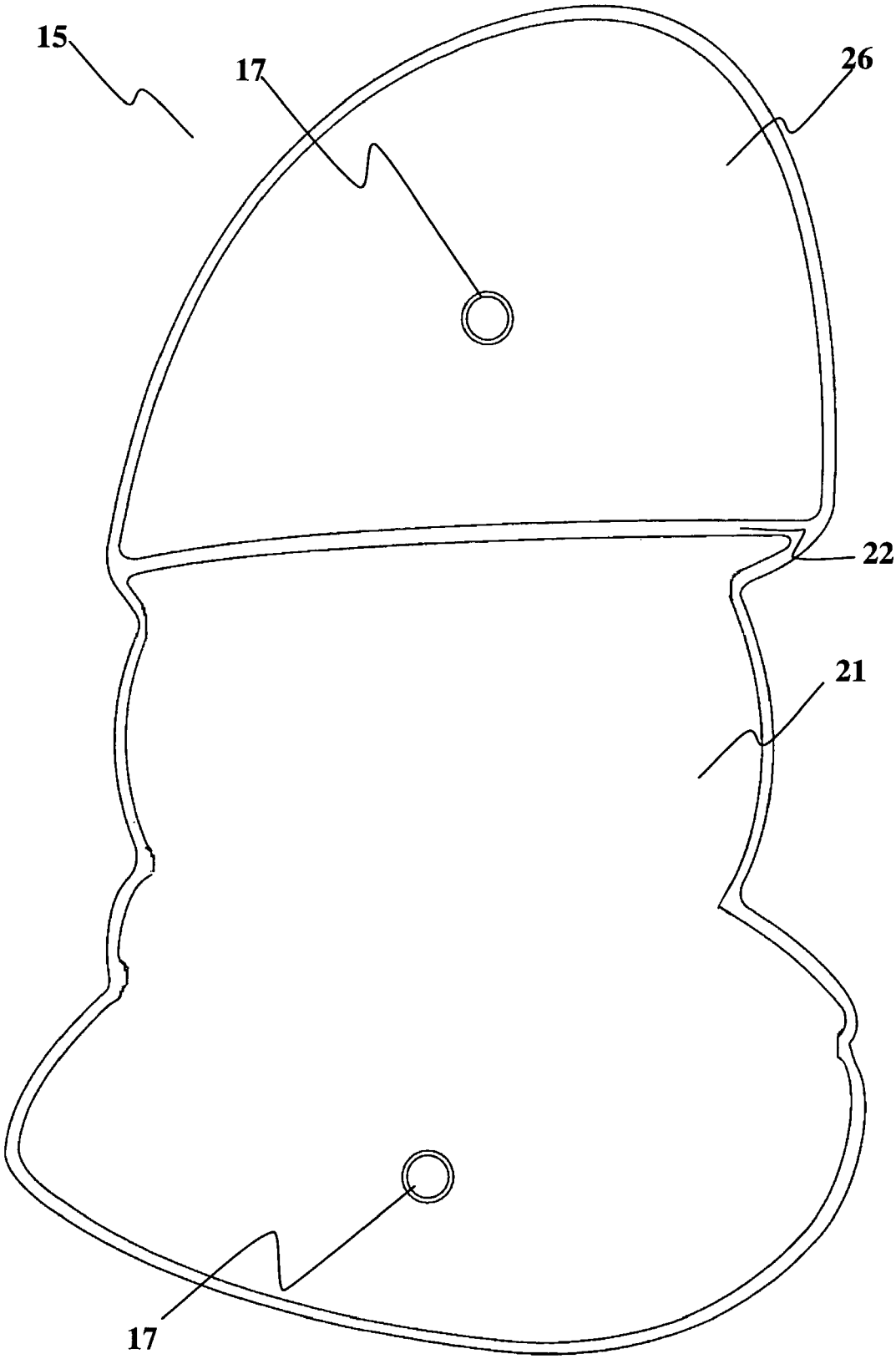
FIG. 3 is an illustration of one embodiment of the first inflatable part wherein the first inflatable part comprises two inflatable chambers from a plane view.

In FIG. 3 a preferred embodiment illustrates a first inflatable part 15 comprising two inflatable chambers 21 and 26. Each of the inflatable chambers 21 and 26 comprises a fluid port 17. The inflatable chambers 21 and 26 are separated by a partition element 22. The larger of the two inflatable chambers 21 is designed such that it may contact the sole, lateral and vamp regions of a foot. The inflatable chamber 26 is designed such that it may contact the plantar arch and sole regions of the foot.

Figure 4:
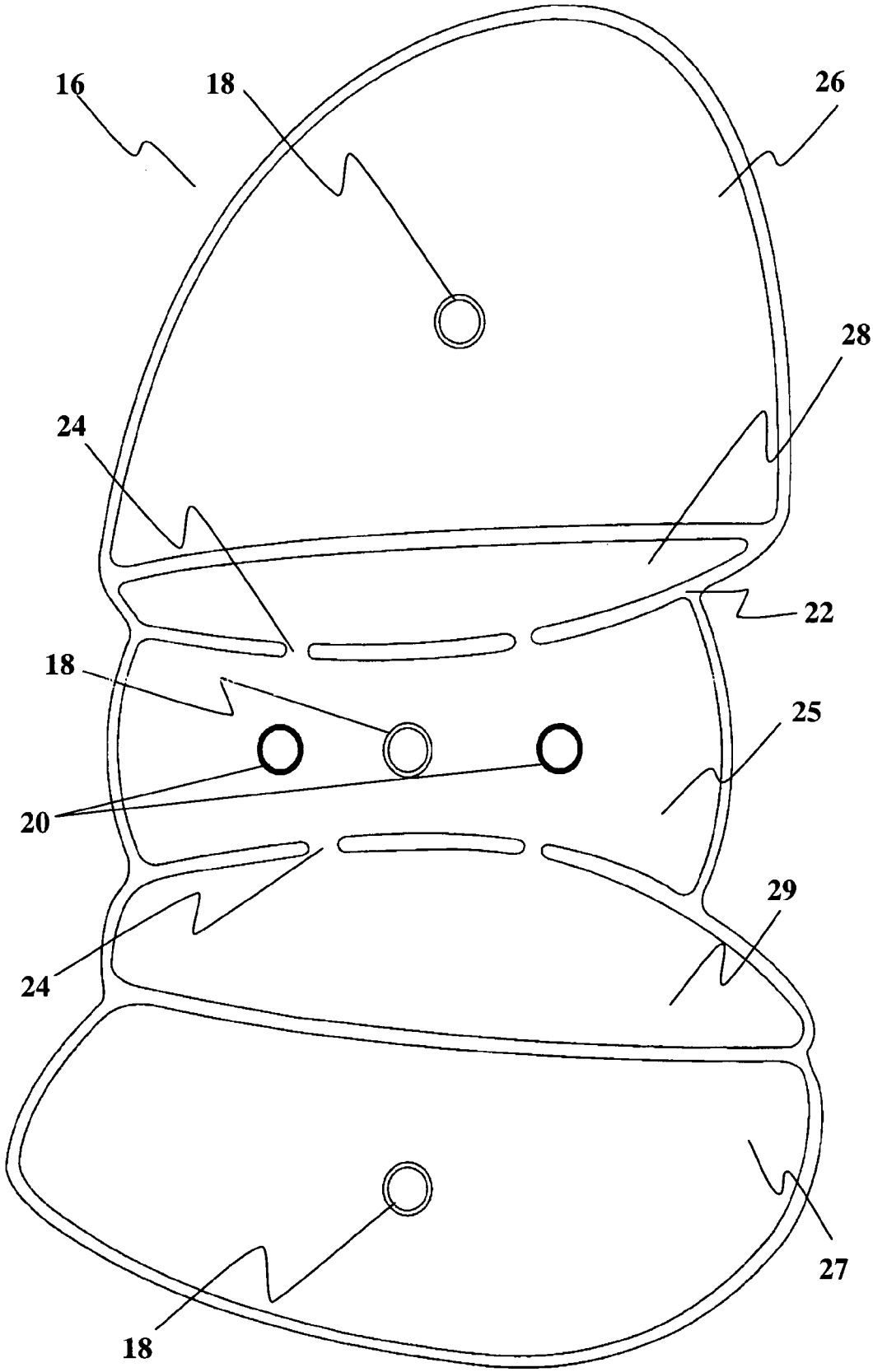
FIG. 4 is an illustration of a second embodiment of the first inflatable part wherein the first inflatable part comprises three inflatable chambers from a plane view.

FIG. 4 is another preferred embodiment of the first inflatable part 16 as shown. In this preferred embodiment, the inflatable part comprises three inflatable chambers 25, 26 and 27 and two sub-chambers 28 and 29. Each inflatable chamber 25, 26 and 27 has one fluid port 18 attached to it to provide for the inflow and outflow of the working fluid. The sub-chambers 28 and 29 are separated from the inflatable chambers 25, 26 and 27 by partition element 22. The partition is partial as unsealed gaps 24 exist and allow fluid contact between the inflatable chamber 25 and sub-chambers 28 and 29. This permits any incoming fluid from the fluid port 18 to fill the inflatable chamber 25 and subsequently, the sub-chambers 28 and 29 via the unsealed gap 24. In addition, the central inflatable chamber 25 comprises two cutouts 20 through which a second inflatable part 30 may be affixed to the first inflatable part 16.

Figure 5:
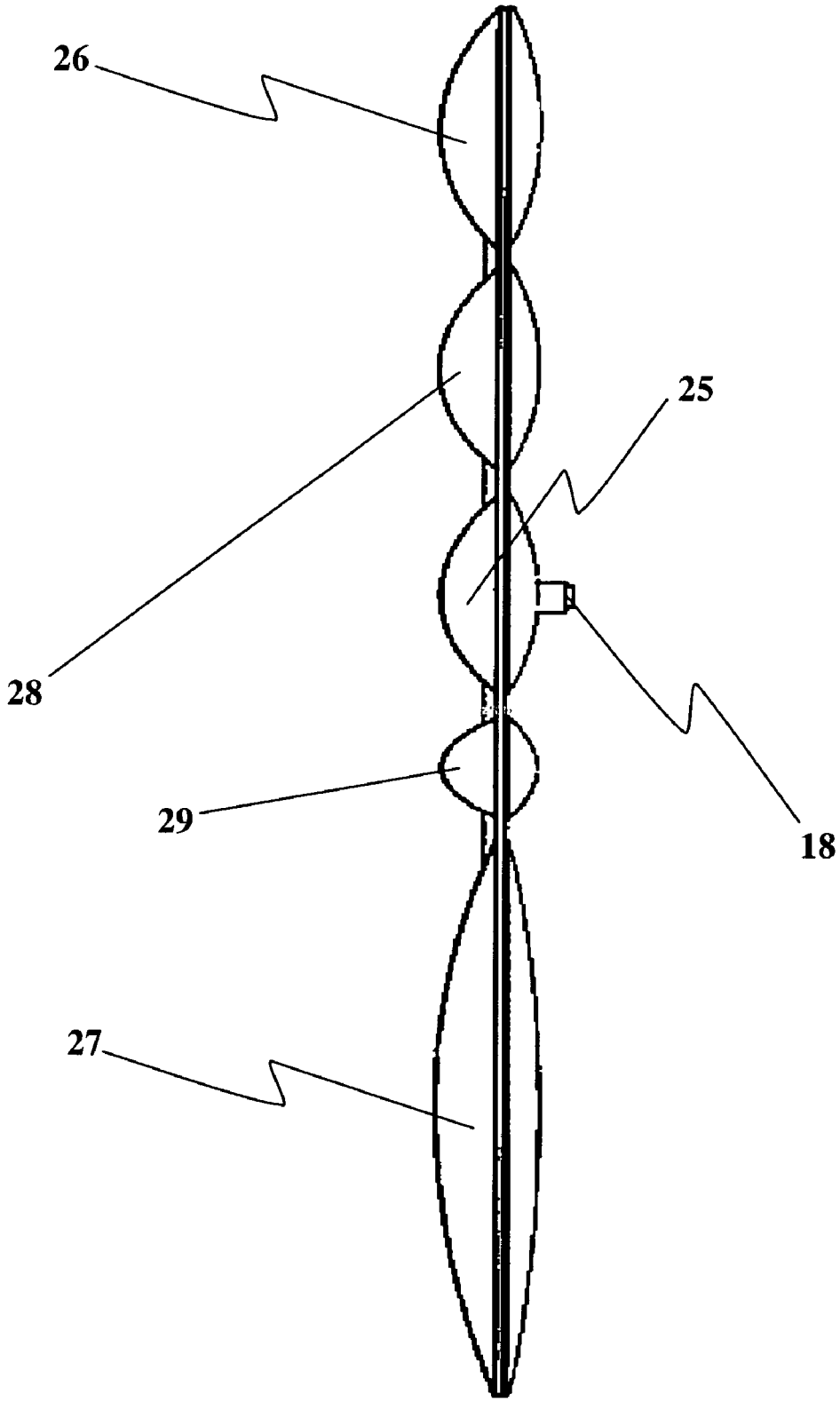
FIG. 5 is an illustration of the second embodiment of the first inflatable part from a side view.

FIG. 5 shows the first inflatable part 16 of FIG. 3 from a side view and with the various main chambers 25, 26 and 27 and sub-chambers 28 and 29 in an inflated position. Each of the inflated main chambers 25, 26 and 27 and sub-chambers 28 and 29 will contact the foot 2 at specific locations during the course of a massage. While the inflatable chambers 25, 26 and 27 are designed to contact general regions of the foot 2 such as the mid-sole and rear-sole regions 10 and 12, plantar arch region 8 and lateral region 4, the sub-chambers 28 and 29 are designed to contact specific points of the foot 2 such as the metatarsal region 6 and heel region 14.

Figure 6:
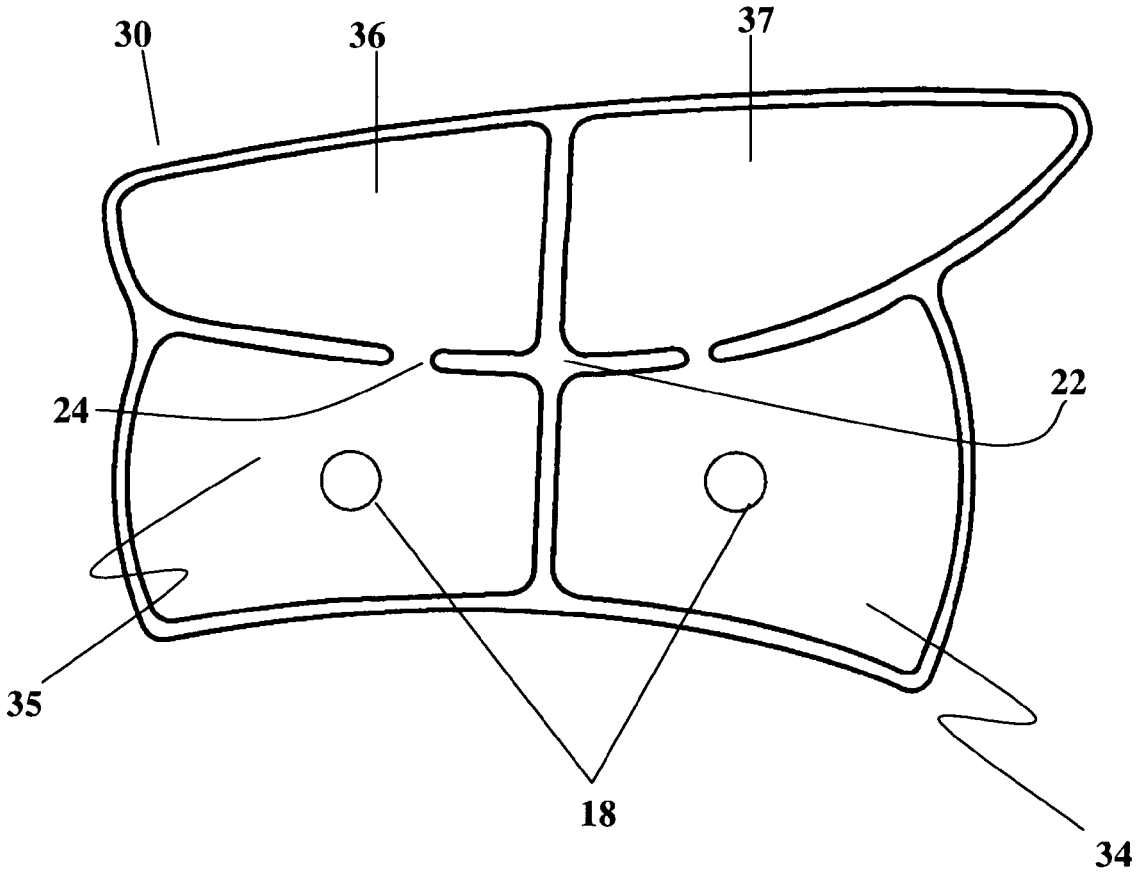
FIG. 6 is an illustration of one embodiment of the second inflatable part from a plane view.
Figure 7:
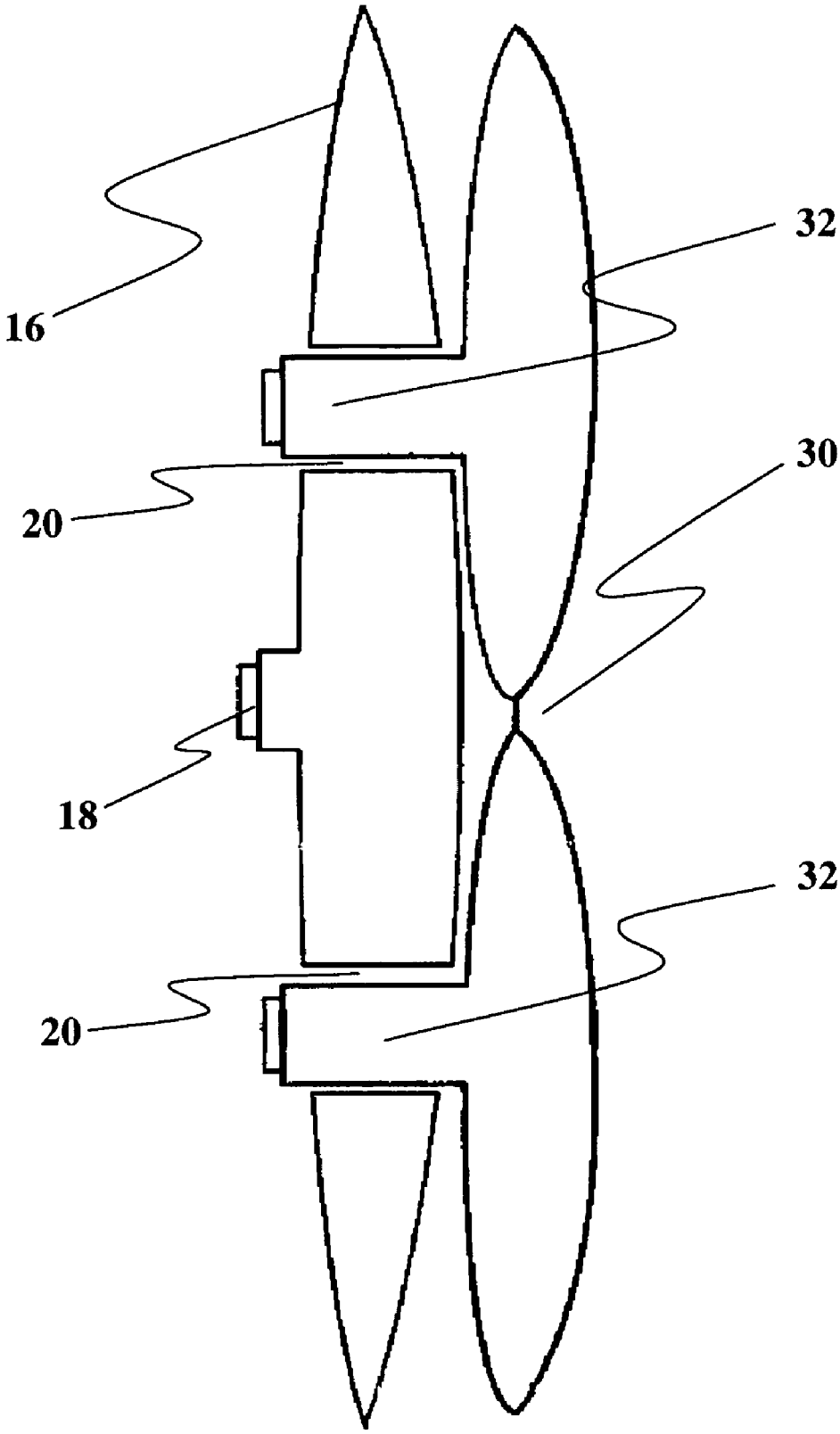
FIG. 7 is an illustration showing one embodiment of the second inflatable part when placed over one embodiment of the first inflatable part as seen from a side view.

FIG. 6 is the top view of another preferred embodiment of the massaging device that comprises, in addition to the first inflatable part 15 or 16, a second inflatable part 30. The second inflatable part 30 may be attached on to the top of the first inflatable part 15 or 16, as illustrated in FIG. 7. The second inflatable part 30 may be attached on to the top of the first inflatable part 15 or 16 in order to provide additional support to the foot 2, to increase the intensity of a massage and to further provide for the contact and subsequent massage of specific points of the foot 2 such as the metatarsal region 6 and the heel region 14. The second inflatable part 30 comprises two inflatable chambers 34 and 35 and in this particular embodiment, two sub- chambers 36 and 37. Each of the inflatable chambers 34 and 35 has attached one fluid port 32. The fluid ports 32 of the second inflatable part 30 are slightly longer in length as compared to the fluid ports 18 of the first inflatable parts 15 or 16. The inflatable chambers 34 and 35 and the sub-chambers 36 and 37 are partially separated by means of a partition element 22 and incorporate gaps 24 to allow for the working fluid to flow from the inflatable chambers 34 and 35 to the sub-chambers 36 and 37.

FIG. 7 shows an embodiment, as mentioned above, where the second inflatable part 30 is attached to the first inflatable part 16. The fluid ports 32 are threaded through cutouts 20. In this illustration, it is clearly shown that the length of the second inflatable part 30 fluid ports 32 is greater then the fluid ports 18 of inflatable part 16.

Figure 8:
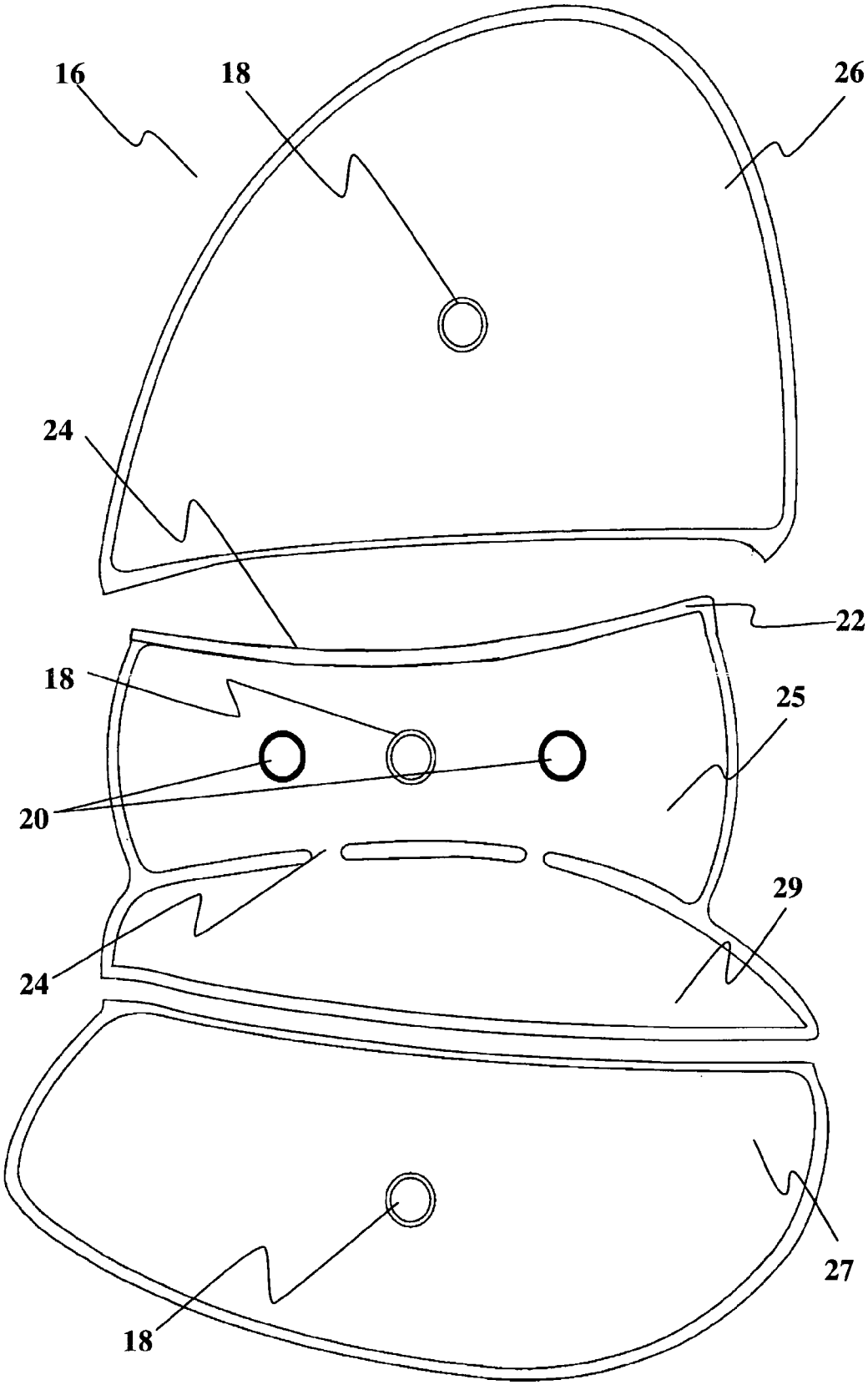
FIG. 8 is an illustration of a third embodiment of the first inflatable part where each of the three inflatable chambers is fabricated as an individual component.

FIG. 8 is another preferred embodiment where each of the inflatable chambers 25, 26 and 27 of the first inflatable part 16 is fabricated as a separate component as illustrated. Each of the inflatable chambers 25, 26 and 27 comprise a fluid port 18 and have the partition element 22 surrounding them completely with the exception of the central inflatable chamber 25. Inflatable chamber 25 further comprises a sub-chamber 29 and another embodiment, may also further comprise sub-chamber 28. This particular embodiment allows for the second inflatable part 30 to be attached to the first inflatable part 16 by threading the fluid ports 32 through cutouts 20 so as to achieve either a tight fit of a snap fit depending upon the design of the fluid ports 32 and the cutouts 20. As is in the non-segmented first inflatable part 16 the fluid contact between the inflatable chamber 25 and sub-chamber 29 exists due to gap 24.

Figure 9A:
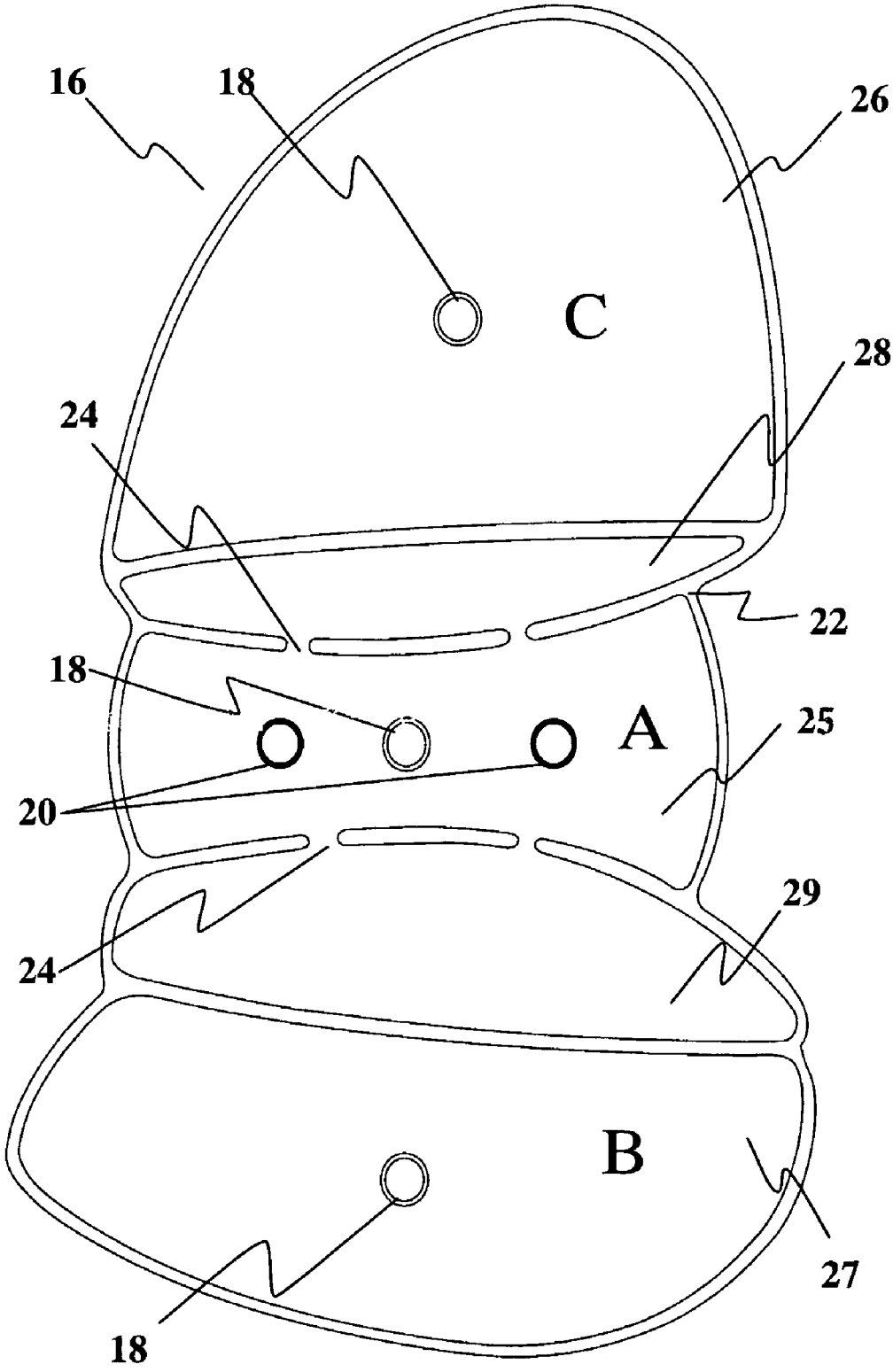
FIG. 9A is an illustration of a first inflatable part wherein the three inflatable chambers A, B and C are indicated.

FIG. 9A is an illustration of an embodiment of a first inflatable part 16 of the massaging device. Typically in this embodiment, the first inflatable part comprises of three inflatable chambers that may comprise of sub-chambers namely, sub-chambers A 25, A 28, A 29, B 27 and C 26. Sub-chambers A 25, A 28 and A 29 are in fluid communication with each other.

Figure 9B:
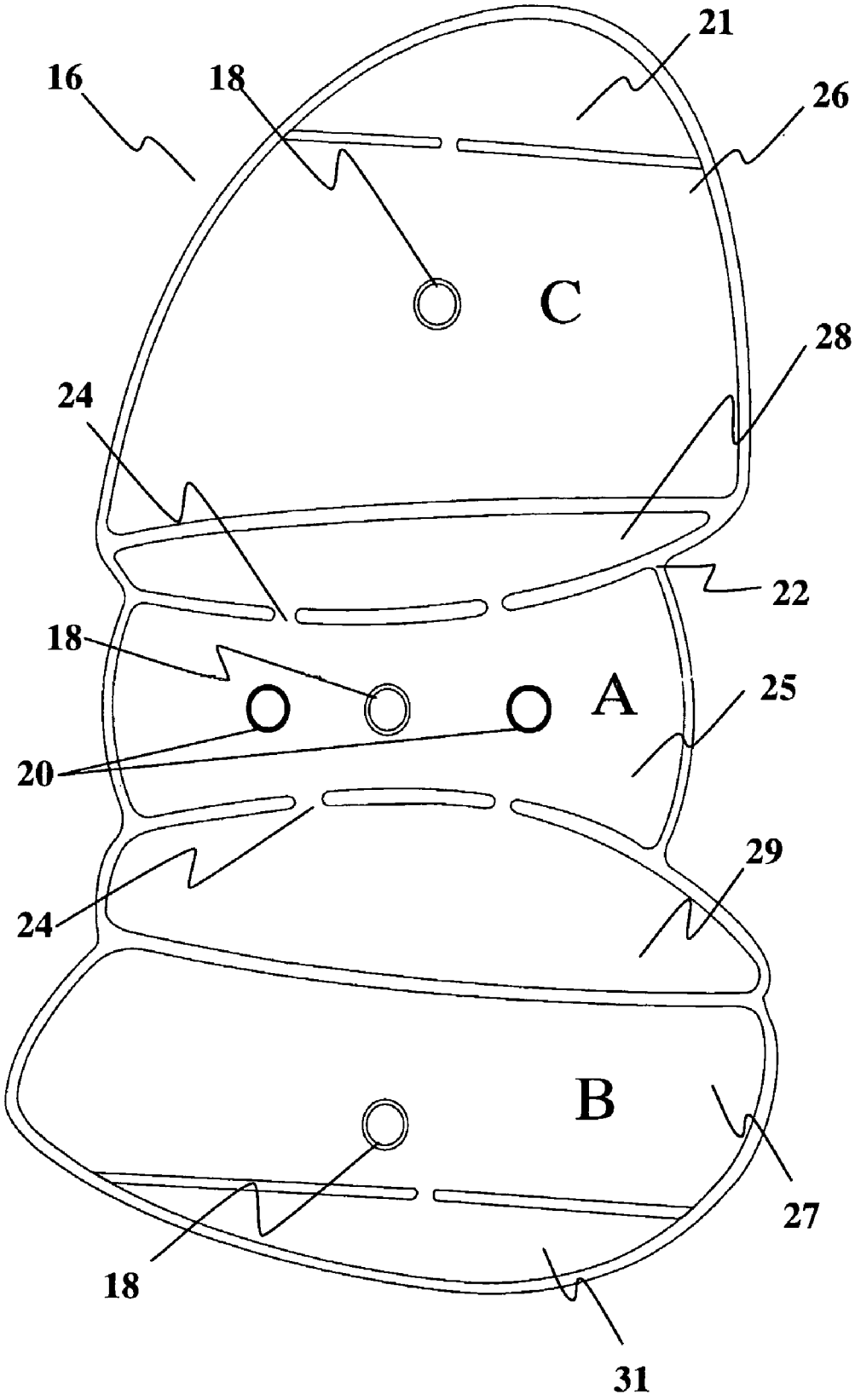
FIG. 9B is an illustration of a first inflatable part wherein each of the three inflatable chambers A, B and C comprise two inflatable sub-chambers.

FIG. 9B is an exemplary embodiment of a first inflatable part 16 of the massaging device that comprises three inflatable chambers wherein each inflatable chamber may comprise of at least two inflatable sub-chambers. As illustrated, sub-chambers A 25, B 27 and C 26 are in fluid communication with adjacent sub-chambers A 28 and A 29, B 23 and C 31 respectively.

Figure 10:
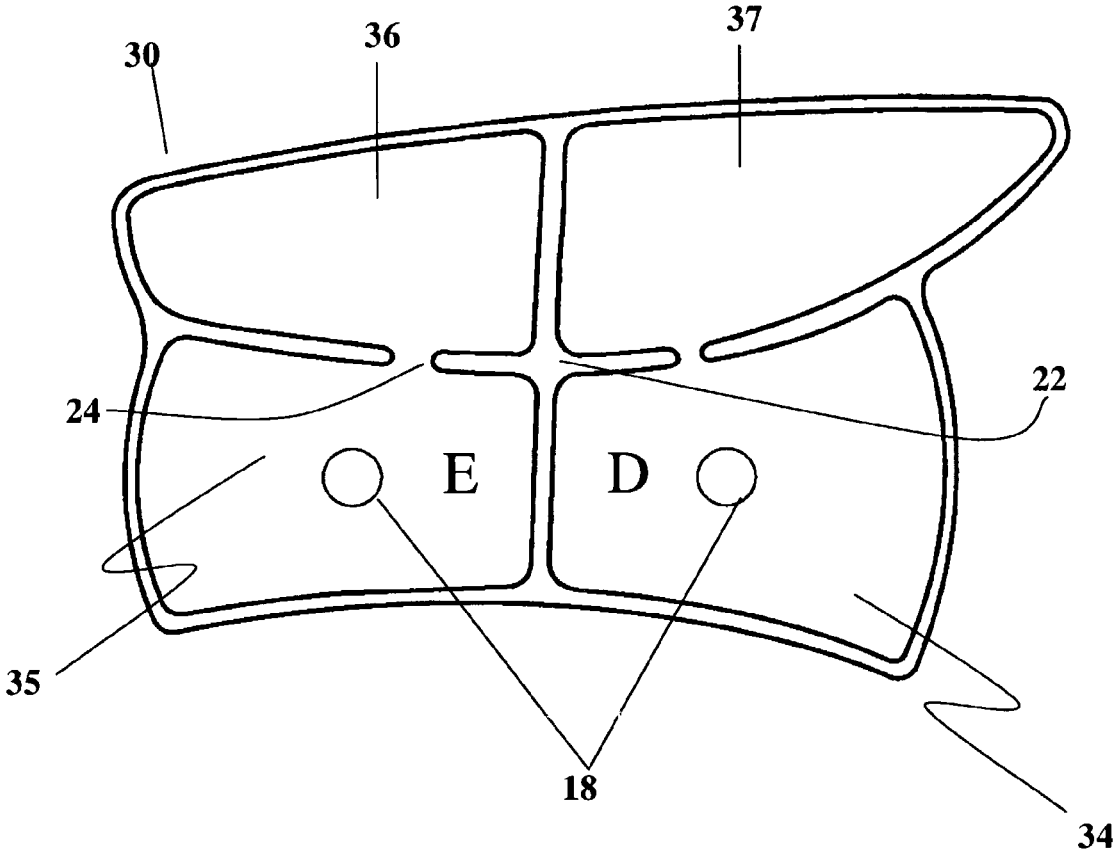
FIG. 10 is an illustration of a second inflatable part wherein the two inflatable chambers D and E are indicated.

FIG. 10 is an illustration of a second inflatable part 30 of the massaging device. Typically, the second inflatable part comprises of two inflatable chambers that comprise at least two sub-chambers namely, sub-chambers D 34 and E 35. As illustrated, inflatable sub-chambers D 34 and E 35 are in fluid communication with inflatable sub-chambers D 37 and E 36 respectively.

Figure 11:
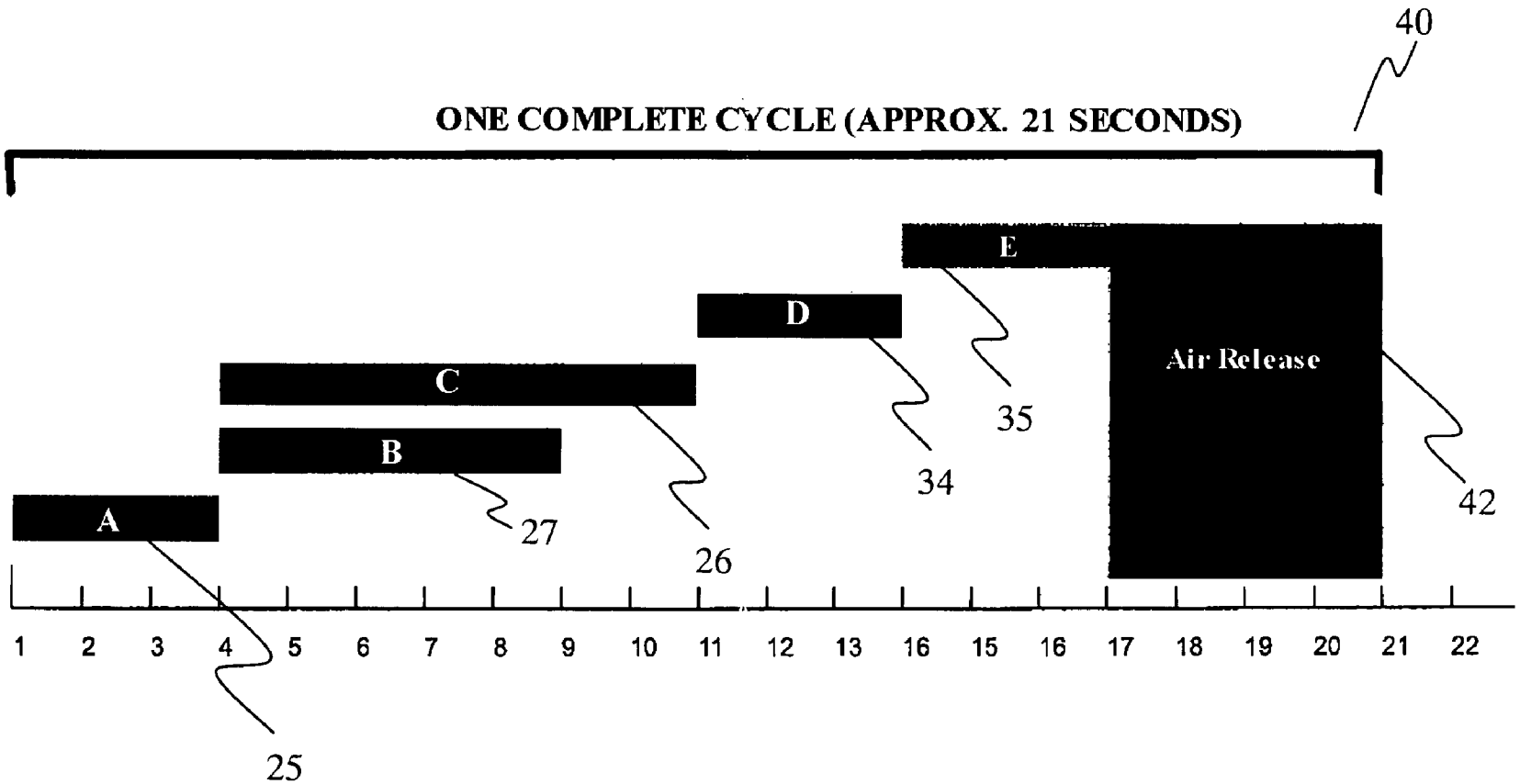
FIG. 11 is an illustration of an a possible inflation sequence using an exemplary embodiment of the massaging device wherein the first inflatable part comprises of three inflatable chambers A, B and C and the second inflatable part comprises of two inflatable chambers D and E.

FIG. 11 is a diagram 40 that shows an exemplary sequence in which each inflatable part and sub-chamber may be inflated. With reference to FIG. 10 and FIG. 11, sub-chamber A 25 of the first inflatable part is inflated for approximately four seconds. Sub-chambers B 27 and C 26 are then inflated concurrently with C 26 taking about two seconds longer than B 27 as it is larger in size. With the first inflatable part fully inflated, sub-chamber D 34 and E 35 of the second inflatable part are sequentially inflated. After the massaging device is fully inflated, all the sub-chambers are vented gradually, a process that may take up to four seconds 42.

It is to be understood that when any of the above-mentioned sub-chambers are inflated, all adjacent sub-chambers are correspondingly inflated provided that the adjacent sub-chambers are in fluid communication with the above-mentioned sub-chambers, namely A 25, B 27 and C 26.

Figure 12:
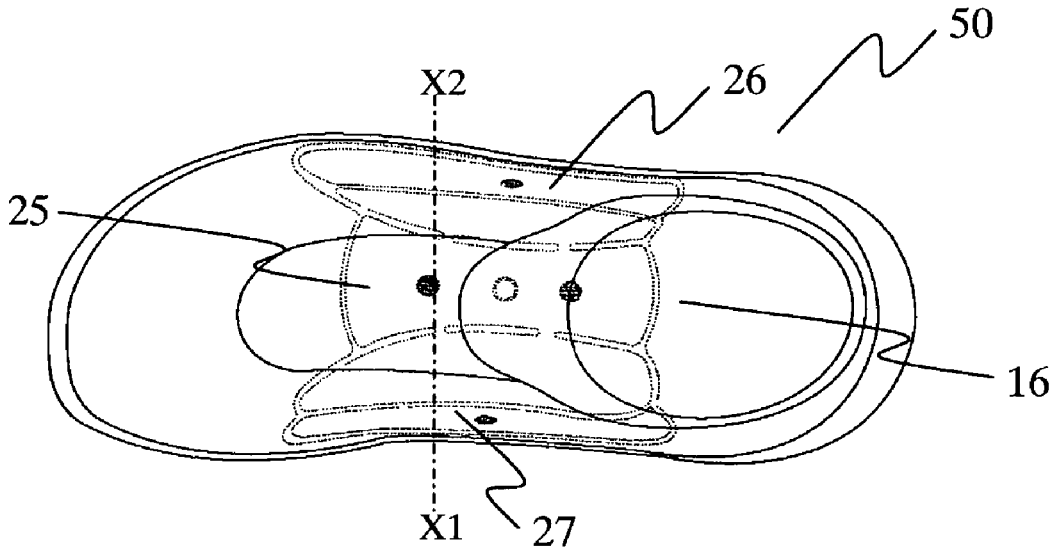
FIG. 12 is a side view and top view of an exemplary embodiment of the massaging device comprising a first inflatable part incorporated within a shoe.
Figure 12:
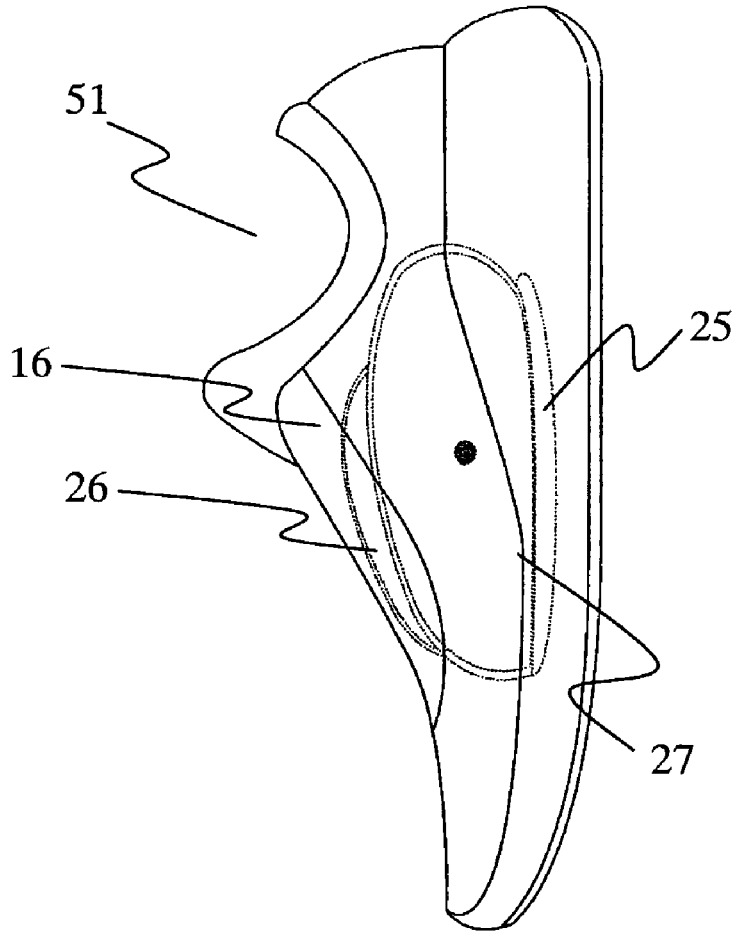

FIG. 12 shows a top view 50 of a shoe for the right foot and a side view 51 of the same shoe with the first inflatable part 16 incorporated in said shoe. In the top view 50, sub-chamber 26 (which corresponds to sub-chamber C of FIG. 11) is situated adjacent to the lateral surface region 4 of the foot. The sub-chamber 25 (which corresponds to sub-chamber A of FIG. 11) is located adjacent to the mid-sole region 10 of the foot. The third sub-chamber 27 (which corresponds to sub-chamber B of FIG. 10) is adjacent to the plantar arch region 8 of the foot. In the side view 51, the position of the first inflatable part 16 is such that it encompasses the lateral surface region 4, plantar arch region 8 and mid-sole region 10.

Figure 13:
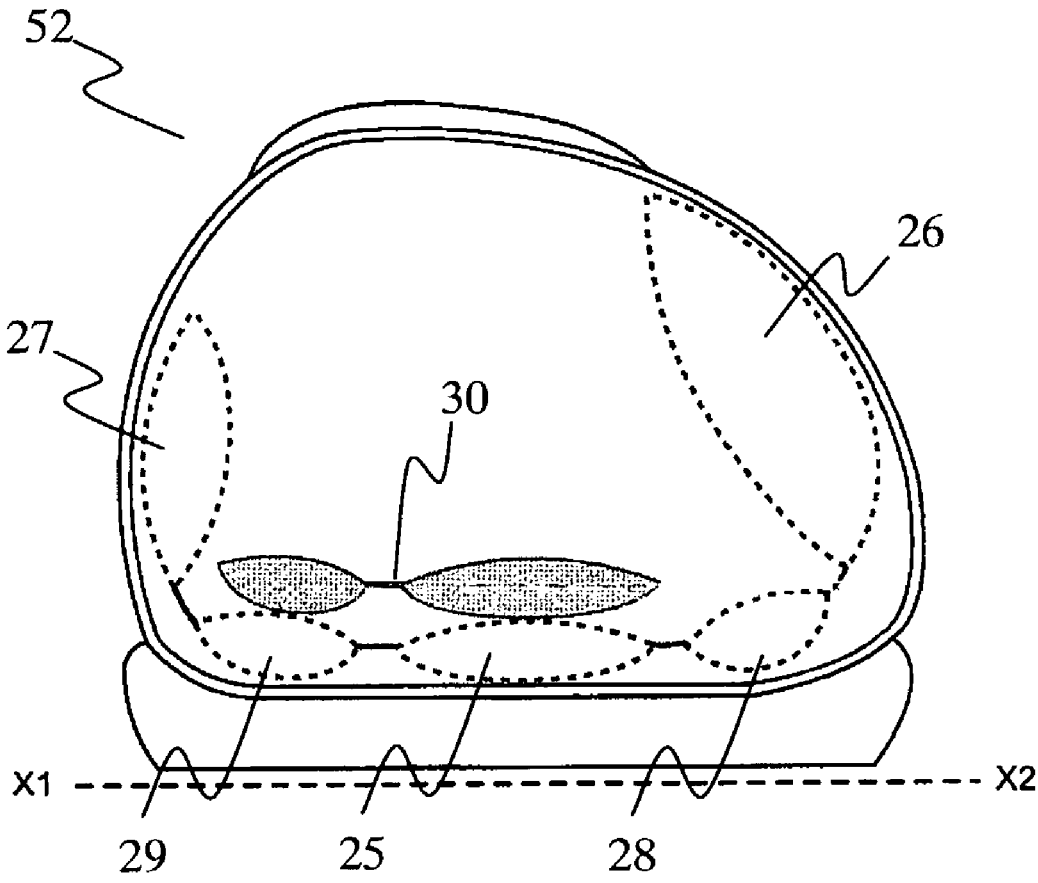
FIG. 13 is a cross-sectional view about the line X1-X2 of the shoe as shown in FIG. 12 and illustrates one exemplary implementation of the massaging device comprising of a first inflatable part and a second inflatable part within a shoe.

FIG. 13 illustrates a cross-sectional view 52 of the shoe, as shown in FIG. 12, about the line X1-X2. The cross-sectional view 52 shows the massaging device comprising of a first inflatable part 16 and a second inflatable part 30. The first inflatable part 16 includes inflatable chambers A 25, B 27 and C 26. The second inflatable part 30 is situated above the inflatable chamber A 25. In this respect, the second inflatable part 30 serves to provide additional stimuli during the massaging process. When a user wears the shoe as such, the inflatable sub-chambers 26 contacts the lateral surface of the foot 4, the second inflatable part 30 contacts the mid-sole region 10 and the rear sole region 12 and the inflatable sub-chamber 27 contacts the planar arch region 8 and the metatarsal region 6 of the foot. The inflatable chamber that comprises inflatable sub-chambers 25, 28, and 29 provides additional support for the mid-sole region 10 and the rear sole region 12 of the foot.

What is claimed is:

1. A pneumatic massaging device comprising:

a first inflatable monolithic part to be in contact with a foot of a user, wherein said first inflatable part comprises at least two inflatable chambers, wherein the first of said at least two inflatable chambers is designed such that it is in contact with the plantar arch and sole regions of the foot and the second of said at least two inflatable chambers is designed such that it is in contact with the sole region, lateral region or vamp region of the foot, and a second inflatable monolithic part to be in contact with the foot of the user, wherein said second inflatable part is arranged to overlap the first inflatable part and comprises at least two inflatable chambers separated by a partition element, said second monolithic inflatable part being adapted with respect to the first inflatable monolithic part to provide additional massage forces to specific regions of the foot.

2. A pneumatic massaging device according to claim 1, wherein said first inflatable monolithic part further comprises a third inflatable chamber wherein said third chamber is designed such that it is in contact with the sole of the foot.

3. A pneumatic massaging device according to claim 1, wherein said first inflatable monolithic part further comprises a plurality of inflatable chambers wherein said plurality of inflatable chambers is designed such that it is in contact with or adjacent to the sole of the foot.

4. A pneumatic massaging device according to claim 2, wherein said third inflatable chamber comprises at least 2 sub-chambers, which are in fluid contact with each other.

5. A pneumatic massaging device according to claim 2, wherein said first, second and third inflatable chambers are integrated into one sheet wherein the third inflatable chamber is located in-between the first and second chambers.

6. A pneumatic massaging device according to claim 2, wherein said first, second and third inflatable chambers integrated into one sheet are each separated from the adjacent inflatable chamber by a partition element.

7. A pneumatic massaging device according to claim 1, wherein said partition element is fabricated by a method selected from the group consisting adhesion bonding, heat sealing, ultrasonic sealing, dielectric sealing method and solvent bonding.

8. A pneumatic massaging device according to claim 1, further comprising a plurality of additional inflatable monolithic parts wherein each of said plurality of inflatable monolithic parts comprises at least 2 inflatable chambers wherein said at least 2 inflatable chambers are separated by a partition element.

9. A pneumatic massaging device according to claim 1, wherein said second inflatable monolithic part or plurality of additional inflatable monolithic parts is attachable to the first inflatable part.

10. A pneumatic massaging device according to claim 1, wherein said second inflatable monolithic part is in contact with regions of a foot wherein said regions comprises the plantar arch region, lateral region and sole region.

11. A pneumatic massaging device according to claim 1, wherein said second monolithic inflatable part is attachable to the first inflatable part by attaching means selected from the group comprising of snap fitting means, glue bonding means, tight fitting means, locking mechanism means and heat bonding means.

12. A pneumatic massaging device according to claim 1, wherein each inflatable chamber comprises at least one fluid port.

13. A pneumatic massaging device according to claim 12, wherein said at least one fluid port is fabricated from materials taken from the group consisting Polyvinyl Chloride (PVC), Polypropylene and elastomers.

14. A pneumatic massaging device according to claim 12, wherein said at least one fluid port allows either unidirectional and bidirectional fluid flow.

15. A pneumatic massaging device according to claim 12, wherein the fluid utilized is a gas.

16. A pneumatic massaging device according to claim 15, wherein said gas is taken from a group comprising air, nitrogen (N2) or any noble gas.

17. A pneumatic massaging device according to claim 12, wherein each at least one fluid port is connected to at least one fluid flow tube.

18. A pneumatic massaging device according to claim 17, wherein each at least one fluid flow tube is further connected to a fluid pump.

19. A pneumatic massaging device according to claim 18, wherein said fluid pump is attached to a pressure regulatory sensor.

20. A pneumatic massaging device according to claim 14, wherein the fluid flow is controlled by a multi-port valve which is adapted to control the fluid flow to the various inflatable chambers and sub-chambers in a sequential or parallel manner.

21. A pneumatic massaging device according to claim 1, wherein on the surface of at least one of the two inflatable monolithic parts, massaging modules are situated such that they are actuated by a pneumatic mechanism and driven in to the foot of a user.

22. A pneumatic massaging device according to claim 1, further comprising a fixed and/or programmable controller.

23. A pneumatic massaging device according to claim 22, wherein said controller regulates the said multi-port valve thereby controlling the inflation and deflation of the inflatable chambers and/or sub-chambers in a sequential or parallel manner.

24. A method of inflating a pneumatic massaging device according to claim 1, the method comprising:

inflating at least two inflatable chambers of the first monolithic inflatable part, inflating at least two inflatable chambers of the second monolithic inflatable part and venting the inflatable chambers of the first and second monolithic inflatable parts.

25. The method of inflating a pneumatic massaging device according to claim 24, wherein the at least two inflatable chambers of the first inflatable monolithic part are inflated sequentially, concurrently or partially concurrent to each other.

26. The method of inflating a pneumatic massaging device according to claim 24, wherein the at least two inflatable chambers of the second inflatable monolithic part are inflated sequentially, concurrently or partially concurrent to each other.

27. The method of inflating a pneumatic massaging device according to claim 24, wherein the at least two inflatable chambers of the second inflatable monolithic part are inflated during or after the inflation of the at least two inflatable chambers of the first monolithic inflatable part.

28. The method of inflating a pneumatic massaging device according to claim 24, wherein the inflatable chambers of the first and second monolithic part are vented either sequentially, concurrently or partially concurrent to each other.

29. The method of inflating a pneumatic massaging device according to claim 24, wherein the said pneumatic massaging device is in contact with a foot.

* * * * *

UNITED STATES PATENT AND TRADEMARK OFFICE

CERTIFICATE OF CORRECTION

PATENT NO. : 8,172,778 B2
APPLICATION NO. : 11/793903
DATED : May 8, 2012
INVENTOR(S) : Sim et al.

It is certified that error appears in the above-identified patent and that said Letters Patent is hereby corrected as shown below:

Title Page, Item (73)

Assignee, "OSIM International, Ltd" should read

-- OSIM International Ltd. --

Signed and Sealed this
Fourteenth Day of August, 2012

David J. Kappos

David J. Kappos
*Director of the United States Patent and Trademark Office*